US011802710B2

(12) United States Patent
Boothroyd

(10) Patent No.: US 11,802,710 B2
(45) Date of Patent: Oct. 31, 2023

(54) ARTICLE AND METHOD FOR DETERMINING AIRFLOW

(71) Applicant: Scott Boothroyd, Lebanon, CT (US)

(72) Inventor: Scott Boothroyd, Lebanon, CT (US)

( * ) Notice: Subject to any disclaimer, the term of this patent is extended or adjusted under 35 U.S.C. 154(b) by 323 days.

(21) Appl. No.: 17/061,153

(22) Filed: Oct. 1, 2020

(65) Prior Publication Data

US 2021/0095880 A1 Apr. 1, 2021

Related U.S. Application Data

(60) Provisional application No. 62/985,935, filed on Mar. 6, 2020, provisional application No. 62/908,968, filed on Oct. 1, 2019.

(51) Int. Cl.

| | |
|---|---|
| ***F24F 11/63*** | (2018.01) |
| ***F24F 11/00*** | (2018.01) |
| ***F24F 11/76*** | (2018.01) |
| *F24F 110/30* | (2018.01) |
| *F24F 110/10* | (2018.01) |
| *F24F 110/12* | (2018.01) |

(52) U.S. Cl.

CPC ..... *F24F 11/63* (2018.01); *F24F 11/0001* (2013.01); *F24F 11/76* (2018.01); *F24F 2110/10* (2018.01); *F24F 2110/12* (2018.01); *F24F 2110/30* (2018.01)

(58) Field of Classification Search

CPC ..... F24F 11/0001; F24F 11/63; F24F 11/76; F24F 2110/10; F24F 2110/12; F24F 2110/30

USPC ..... 454/229

See application file for complete search history.

(56) References Cited

U.S. PATENT DOCUMENTS

| | | | | |
|---|---|---|---|---|
| 5,292,280 | A | 3/1994 | Janu et al. | |
| 5,564,626 | A * | 10/1996 | Kettler | F24F 3/044 55/471 |
| 6,227,961 | B1 * | 5/2001 | Moore | F04D 27/004 454/236 |
| 8,195,335 | B2 | 6/2012 | Kreft et al. | |
| 8,235,777 | B2 | 8/2012 | Stanimirovic | |
| 9,494,334 | B2 | 11/2016 | Sipe et al. | |

(Continued)

*Primary Examiner* — Avinash A Savani
*Assistant Examiner* — Dana K Tighe
(74) *Attorney, Agent, or Firm* — CANTOR COLBURN LLP; Steven M. McHugh

(57) ABSTRACT

A method for measuring outside airflow and return airflow is provided for an air handling system that includes an outside air inlet, a mixed air chamber, a return air inlet, a supply air outlet and a supply fan having a Supply Airflow Station with a fixed area, wherein the mixed air chamber is separated from the outside air inlet via a damper having a plurality of first damper slats. The method includes determining if the Temperature Differential (TD) between the Outside Air and the Return Air is greater than 10° F., where if the TD is greater than 10° F., then determining a position of the first damper slats, and referencing a reference table to identify the percent of outside airflow into the outside air inlet ($CFM_{OA}$), the actual return airflow ($CFM_{RA}$) and the total supply air outflow ($CFM_{SA}$) responsive to the position of the first damper slats.

20 Claims, 5 Drawing Sheets

(56) References Cited

U.S. PATENT DOCUMENTS

| | | | |
|---|---|---|---|
| 9,500,382 | B2 | 11/2016 | Saito et al. |
| 9,765,984 | B2 | 9/2017 | Smith et al. |
| 9,765,986 | B2 | 9/2017 | Thomle et al. |
| 10,060,642 | B2 | 8/2018 | Sikora et al. |
| 2016/0348936 | A1 | 12/2016 | Johnson, Jr. et al. |
| 2018/0299155 | A1 | 10/2018 | Walsh et al. |

* cited by examiner

ARTICLE AND METHOD FOR DETERMINING AIRFLOW

CROSS-REFERENCE TO RELATED APPLICATIONS

This application is related to and claims benefit of priority of the filing dates of U.S. Provisional Patent Application Ser. No. 62/908,968, filed Oct. 1, 2019 and U.S. Provisional Patent Application Ser. No. 62/985,935, filed Mar. 6, 2020, the contents of both of which are incorporated herein by referenced in their entireties.

TECHNICAL FIELD OF THE INVENTION

The present invention relates generally to measuring airflow in a predefined area, and more particularly to an article and method for accurately measuring an airflow within a predefined area.

BACKGROUND OF THE INVENTION

In Heating, Ventilation and Air Conditioning (HVAC) systems air balancing is the process that involves configuring the HVAC system in such a way as to make sure that the air is evenly distributed throughout the building. This is accomplished by making sure that all of the building zones have the correct amount of heat transfer so that all of the components of the HVAC system work in harmony. In general, a Testing, Adjusting and Balancing (TAB) specialist typically performs air and hydronic measurements on the HVAC system and adjusts (i.e. balances) the airflow as required in order to achieve optimal performance of the building environmental equipment. This balancing is usually based upon the design flow values for the building design. Accordingly, it is important to balance the airflow at key locations of the building in order to achieve this optimal performance.

One current method for accomplishing balancing an HVAC system involves using multiple metrics to determine the actual outside airflow ($CFM_{OA}$) in Cubic Feet Minute (CFM), the actual supply airflow ($CFM_{SA}$) in Cubic Feet Minute (CFM) and the actual return airflow ($CFM_{RA}$) in Cubic Feet Minute (CFM). The metrics used to determine these actual values sometimes include the fixed area (AF) for which the airflow is being delivered, the velocity of the airflow at an predetermined fixed area ($V_{AF}$), the outside air temperature ($T_{OA}$), the return air temperature ($T_{RA}$), the mixed air temperature ($T_{MA}$) and the percentage of outside air relative to the total supply air (OA %). Typically, the TAB specialist measures (or is provided) the airflow in cubic feet per minute for total airflow for the supply fan, the $T_{OA}$, the $T_{RA}$ and the $T_{MA}$. Using these values, the TAB specialist then calculates the actual outside airflow ($CFM_{OA}$) and actual return airflow ($CFM_{RA}$) for the total airflow for the supply fan using the following formulas:

$$\%\ \text{Outside Air}=((T_{RA}-T_{MA})/(T_{RA}-T_{OA}))*100;$$

$$CFM_{OA}=(\%\ \text{Outside Air})*(V_{AF}*AF);$$

$$CFM_{RA}=(V_{AF}*AF)-CFM_{OA}.$$

Using these values, the TAB specialist adjusts airflows as required to balance the HVAC system.

Unfortunately however, while this particular method for determining the actual airflow values is sufficient for temperature differentials between the outside air temperature ($T_{OA}$) and the return air temperature ($T_{RA}$) that are more than 10° F., these current methods produce inaccurate results for temperature differentials between the outside air temperature ($T_{OA}$) and the return air temperature ($T_{RA}$) that are less than 10° F. This is undesirable because if the HVAC system is not properly balanced the HVAC system may operate in efficiently, thereby affecting the operating costs of the HVAC system as well as the life expectancy of the HVAC system components and life safety factors based on minimum outdoor air requirements.

SUMMARY OF THE INVENTION

An Airflow Measuring System (AMS) for measuring outside airflow and return airflow for an air handling system is provided, wherein the air handling system includes an outside air inlet, a mixed air chamber, a return air inlet, a supply air outlet and a supply fan having a Supply Airflow Station (SAS) with a fixed area, wherein the mixed air chamber is separated from the outside air inlet via a first damper having at least one configurable first damper slat. The AMS includes an Outside Air Temperature Sensor (OATS) located proximate the outside air inlet, a Return Air Temperature Sensor (RATS) located proximate the return air inlet, a Mixed Air Temperature Sensor (MATS) located within the mixed air chamber, a damper actuator, wherein the damper actuator is communicated with the first damper to configure the at least one first damper slat between an open configuration and a closed configuration, and a processing device, wherein the processing device is configured to receive temperature information from the OATS, the RATS and the MATS and Supply Air Output Velocity (SAOV) information from the SAS and is communicated with the damper actuator to configure the at least one first damper slat between an open configuration and a closed configuration. If the Temperature Differential (TD) between the Outside Air (OA) and the Return Air (RA) is greater than or equal to a predetermined TD, the processing device is configured to process the temperature information from the OATS, the RATS and the MATS and Supply Air Output Velocity (SAOV) information from the SAS and calculate a percent of outside airflow into the outside air inlet ($CFM_{OA}$) value, an actual return airflow ($CFM_{RA}$) value and a total supply air outflow ($CFM_{SA}$) value, wherein if the Temperature Differential (TD) between the Outside Air (OA) and the Return Air (RA) is less than the predetermined TD, the processing device is configured to determine the position of the at least one first damper slat and determine the percent of outside airflow into the outside air inlet ($CFM_{OA}$) value, the actual return airflow ($CFM_{RA}$) value and the total supply air outflow ($CFM_{SA}$) value via a predetermined reference table.

An Airflow Measuring System (AMS) for measuring outside airflow and return airflow for an air handling system is provided, wherein the air handling system includes an outside air inlet, a mixed air chamber, a return air inlet, a supply air outlet and a supply fan having a Supply Airflow Station (SAS) with a fixed area, wherein the mixed air chamber is separated from the outside air inlet via a first damper having at least one configurable first damper slat. The AMS includes an Outside Air Temperature Sensor (OATS) located proximate the outside air inlet, a Return Air Temperature Sensor (RATS) located proximate the return air inlet, a Mixed Air Temperature Sensor (MATS) located within the mixed air chamber, a damper actuator, wherein the damper actuator is communicated with the first damper to configure the at least one first damper slat between an open configuration and a closed configuration, and a processing device, wherein the processing device is configured to receive temperature information from the OATS, the RATS and the MATS and Supply Air Output Velocity (SAOV) information from the SAS and is communicated with the damper actuator to configure the at least one first damper slat between an open configuration and a closed configuration. If the Temperature Differential (TD) between the Outside Air (OA) and the Return Air (RA) is greater than or equal to 10° F., the processing device is configured to process the temperature information from the OATS, the RATS and the MATS and Supply Air Output Velocity (SAOV) information from the SAS and calculate a percent of outside airflow into the outside air inlet ($CFM_{OA}$) value, an actual return airflow ($CFM_{RA}$) value and a total supply air outflow ($CFM_{SA}$) value responsive to, $$\%\ \text{Outside Air}=((T_{RA}-T_{MA})/(T_{RA}-T_{OA}))*100;$$

$$CFM_{SA}=(V_{AF}*AF);$$

$$CFM_{OA}=(\%\ \text{Outside Air})*(V_{AF}*AF);$$

$$CFM_{RA}=(V_{AF}*AF)-CFM_{OA},$$

wherein if the Temperature Differential (TD) between the Outside Air (OA) and the Return Air (RA) is less than 10° F., the processing device is configured to determine the position of the at least one first damper slat and determine the percent of outside airflow into the outside air inlet ($CFM_{OA}$) value, the actual return airflow ($CFM_{RA}$) value and the total supply air outflow ($CFM_{SA}$) value via a predetermined reference.

A method for measuring outside airflow and return airflow for an air handling system is provided, wherein the air handling system includes an outside air inlet, a mixed air chamber, a return air inlet, a supply air outlet and a supply fan having a Supply Airflow Station (SAS) with a fixed area, wherein the mixed air chamber is separated from the outside air inlet via a first damper having at least one configurable first damper slats, wherein the method is implemented via an Airflow Measuring System (AMS) having an Outside Air Temperature Sensor (OATS) located proximate the outside air inlet, a Return Air Temperature Sensor (RATS) located proximate the return air inlet, a Mixed Air Temperature Sensor (MATS) located within the mixed air chamber, a damper actuator, wherein the damper actuator is communicated with the first damper to configure the at least one first damper slat between an open configuration and a closed configuration, and a processing device, wherein the processing device is configured to receive temperature information from the OATS, the RATS and the MATS and Supply Air Output Velocity (SAOV) information from the SAS and damper position information and is communicated with the damper actuator to configure the at least one first damper slat between an open configuration and a closed configuration. The method includes determining if the Temperature Differential (TD) between Outside Air (OA) and Return Air (RA) is greater than or equal to 10° F. If the TD is less than 10° F., then determining a position of the at least one configurable first damper slat, and referencing a predetermined reference table to identify a percent of outside airflow into the outside air inlet ($CFM_{OA}$) value, an actual return airflow ($CFM_{RA}$) value and a total supply air outflow ($CFM_{SA}$) value responsive to the position of the at least one configurable first damper slat. If the TD is greater than or equal to 10° F., then processing temperature information from the OATS, the RATS and the MATS and Supply Air Output Velocity (SAOV) information from the SAS to determine the percent of outside airflow into the outside air inlet ($CFM_{OA}$) value, the actual return airflow ($CFM_{RA}$) value and the total supply air outflow ($CFM_{SA}$) value.

BRIEF DESCRIPTION OF THE DRAWINGS

The foregoing and other features and advantages of the present invention should be more fully understood from the accompanying detailed description of illustrative embodiments taken in conjunction with the following Figures in which like elements are numbered alike in the several Figures.

DETAILED DESCRIPTION OF THE INVENTION

Referring to the FIG.'s, a system and method for accurately measuring outside airflow for an HVAC system across a wide temperature range is provided and disclosed, in accordance with one embodiment of the invention.

Figure 1:
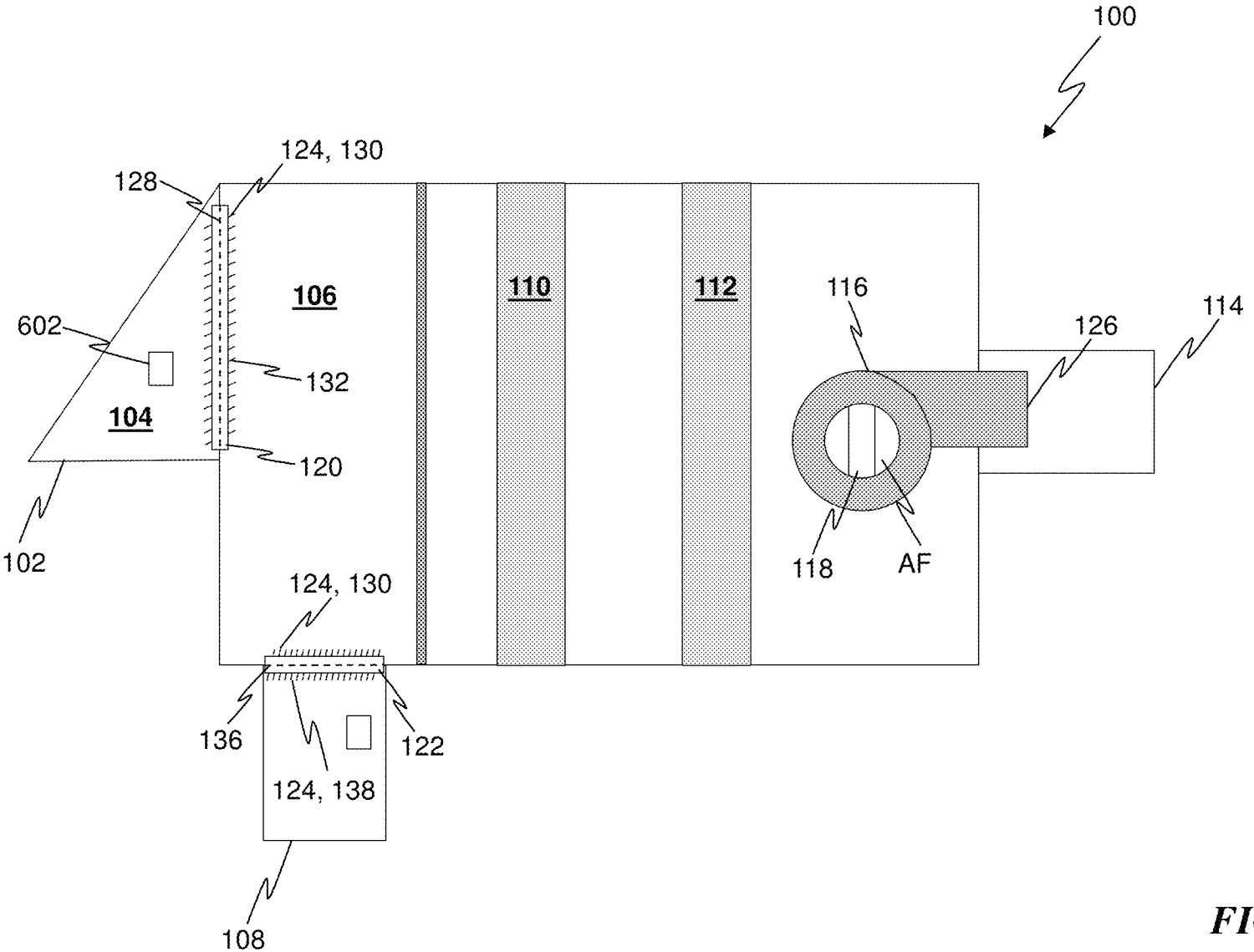
FIG. 1 shows a schematic block diagram of an HVAC system, in accordance with the prior art.
Figure 2:
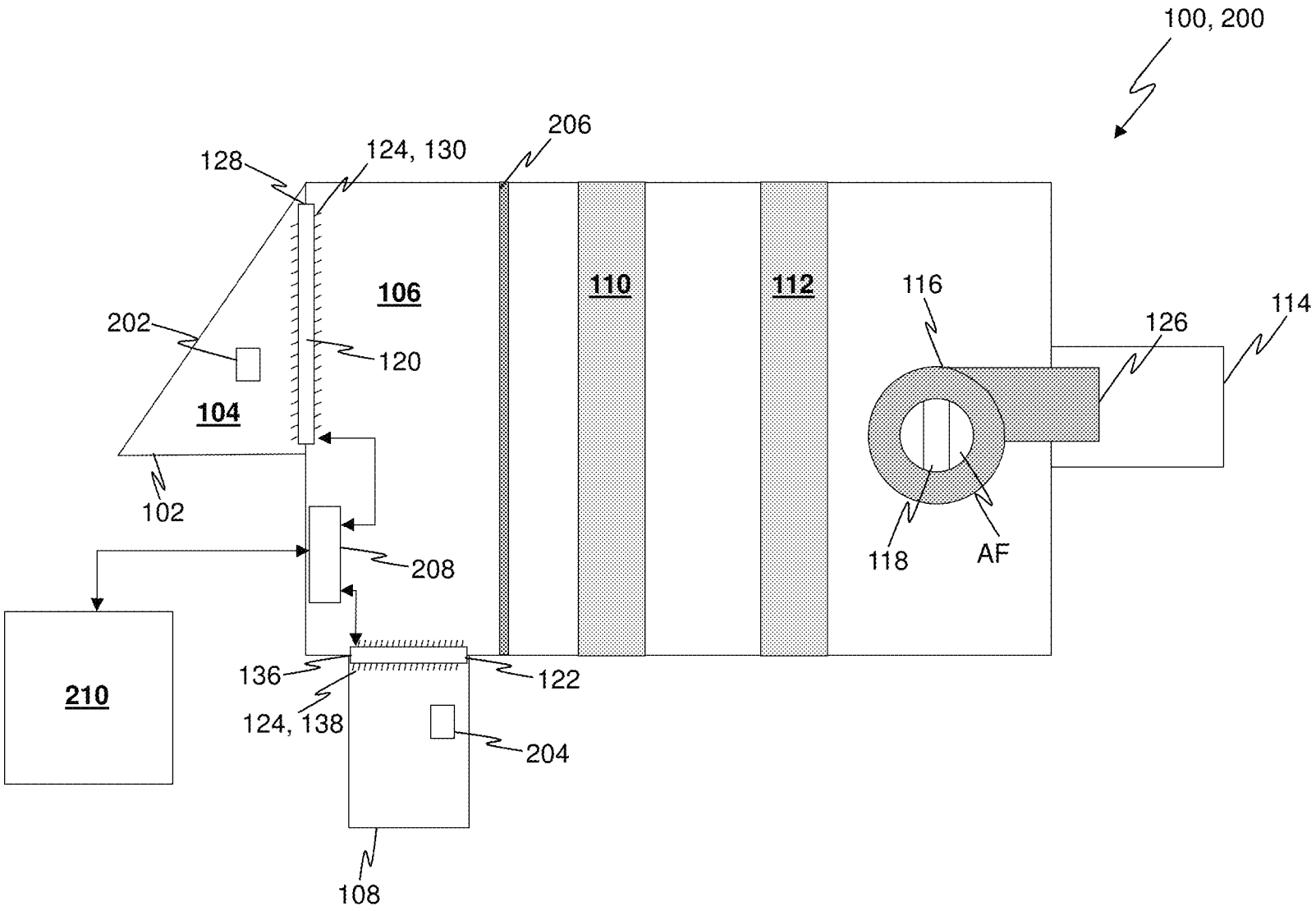
FIG. 2 shows a schematic block diagram of an HVAC system having a system for measuring airflow across a wide temperature range, in accordance with one embodiment of the invention.

Referring to the FIG. 1 and FIG. 2, an HVAC system 100 is shown and includes an outside air inlet 102, an outside air chamber 104, a mixed air chamber 106, a return air inlet 108, a cooling coil 110, a heating coil 112, a supply air outlet 114 and a supply fan 116 having a Supply Fan Airflow Station (SAS) 118 with a fixed area (AF), wherein the outside air chamber 104 is in flow communication with and separated from the mixed air chamber 106 via a first damper 120 and wherein the return air inlet 108 is in flow communication with (and separated from) the mixed air chamber 106 via a second damper 122. It should be appreciated that the first damper 120 and/or the second damper 122 may include a plurality of slats 124 that may be controllably opened and closed via one or more actuators (manual and/or electrical) to allow air to flow into the mixed air chamber 106. It should be further appreciated that the cooling coil 110, heating coil 112 and supply fan 116 may be located within the mixed air chamber 106. Moreover, the supply fan 116 includes a fan outlet 126 which is communicated with the supply air outlet (SAO) 114 such that airflow generated by the supply fan 116 and output via the fan outlet 126 is directed out of the SAO 114.

Figure 4A:
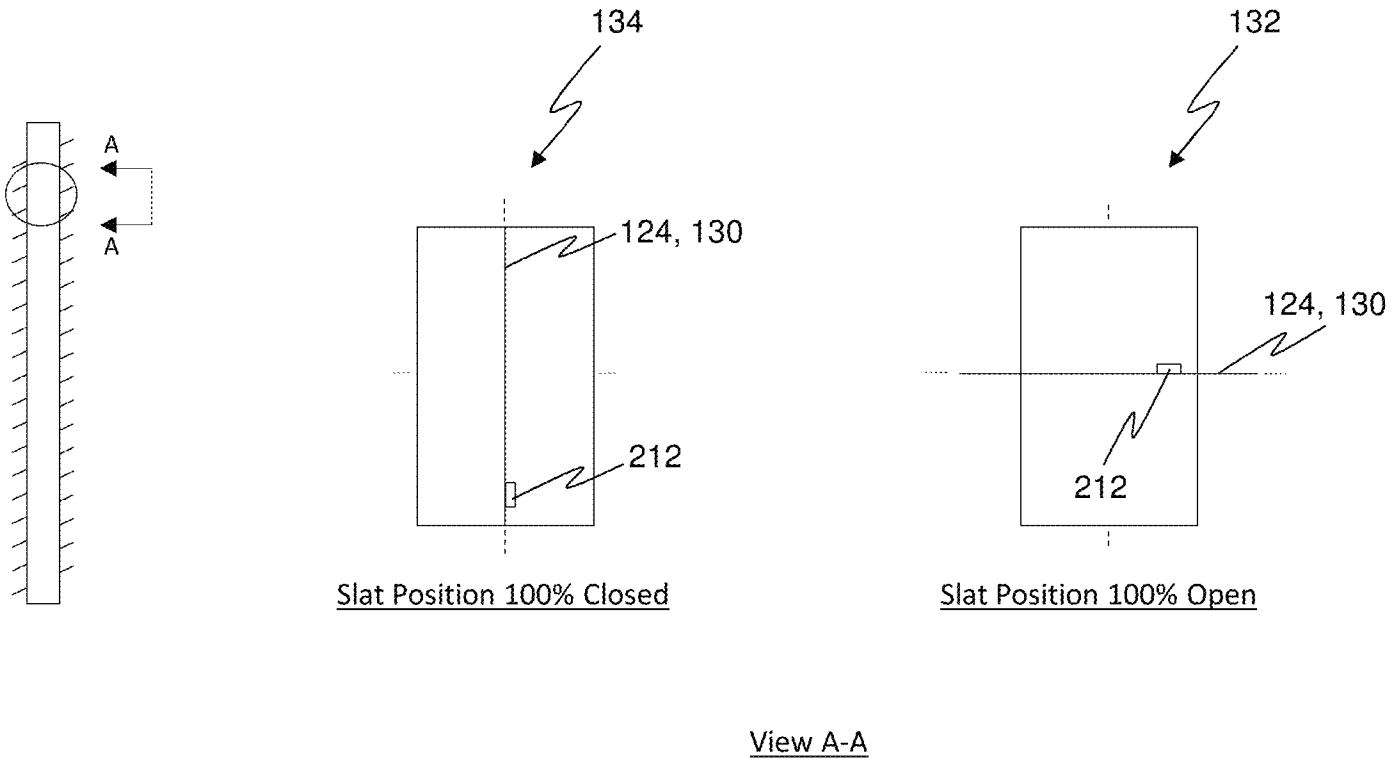
FIG. 4A illustrates a front view of a slat from the plurality of slats with the slat in the closed position, in accordance with one embodiment of the present invention.
Figure 4B:
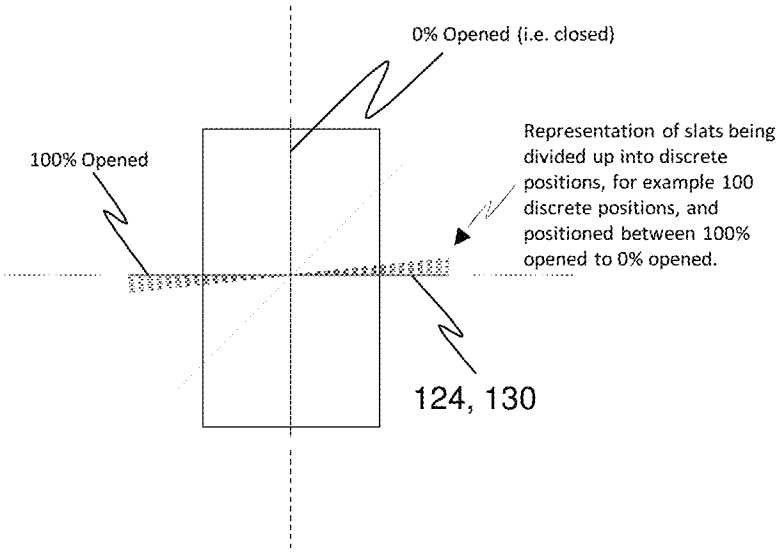
FIG. 4B illustrates a front view of a slat of the plurality of slats of FIG. 4A with the slat in the open position, in accordance with one embodiment of the present invention.

It should be appreciated that the first damper 120 includes a first damper opening 128 and a plurality of first damper slats 130 disposed to cover the first damper opening 128, wherein the first damper slats 130 are configurable between an open configuration 132 and a closed configuration 134 (See FIG. 4A). Accordingly, when the first damper slats 130 are configured in the open configuration 132, air may flow through the first damper opening 128 and when the first damper slats 130 are configured in the closed configuration 134, the airflow through the first damper opening 128 is impeded or prevented from flowing. It should be further appreciated that the second damper 122 includes a second damper opening 136 and a plurality of second damper slats 138 disposed to cover the second damper opening 136, wherein the second damper slats 138 are configurable between an open configuration 132 and a closed configuration 134 (See FIG. 4A). Accordingly, when the second damper slats 138 are configured in the open configuration 132, air may flow through the second damper opening 136 and when the second damper slats 138 are configured in the closed configuration 134, the airflow through the second damper opening 136 is impeded or prevented from flowing.

Referring again to FIG. 2, an Airflow Measuring System 200 for measuring outside airflow and return airflow for an HVAC system 100 across a wide temperature range is provided and includes an outside air temperature sensor (OATS) 202, a return air temperature sensor (RATS) 204, a mixed air temperature sensor (MATS) 206, a damper controller/actuator 208, a processing device 210 and an inclinometer 212 (See FIG. 4A), wherein the inclinometer 212 is configured to measure the angle of the slats 124. The OATS 202 may be located within the outside air chamber 104, the RATS 204 may be located within the return air inlet 108, the MATS 206 may be located within the mixed air chamber 106 and the inclinometer 212 may be associated with the first damper 120 and/or the second damper 122. It should be appreciated that in other embodiments, the OATS 202 may be located outside of the HVAC system 100, in general, or exposed to the outside air. It should be appreciated that in one embodiment an inclinometer 212 is used to measure the angle of the slats 124, while in other embodiments, any article and/or method for measuring the angle of the slats 124 may be used as desired, such as for example, using the position of the motor to identify the position of the slats.

It should be further appreciated that the processing device 210 is configured to be in signal communication (hardwired and/or wirelessly) with the OATS 202, the RATS 204, the MATS 206, the SAS 118, the damper controller/actuator 208 and/or the inclinometer 212. Accordingly, the processing device 210 may receive temperature information from the OATS 202, the RATS 204 and the MATS 206, Supply Air Output Velocity (SAOV) ($V_{AF}$) information from the SAS 118 and damper information (such as the position of the slats 124) from the inclinometer 212. It should be appreciated that the SAOV ($V_{AF}$) may be determined via any method suitable to the desired end purpose, such as by locating a sensor at the fan outlet 126, the supply air outlet 114 (or farther down the line) and/or the SAOV ($V_{AF}$) may be determined and provided by the supply fan 116. It is contemplated that in at least one embodiment, the processing device 210 may continuously (or periodically as desired) monitor the airflow of system 100 and automatically (or as desired) adjust the first damper 120 and/or the second damper 122 as desired. Additionally, it is contemplated that the processing device 210 may be communicated with the OATS 202, the RATS 204, the MATS 206, the SAS 118, and/or the inclinometers 212 of the first damper 120 and/or the second damper 122 to be able to monitor (in real time or periodically) the status of the OATS 202, the RATS 204, the MATS 206, the SAS 118, the first damper 120 and/or the second damper 122, as desired.

It should be appreciated that while in one embodiment of the invention, the first damper 120 and second damper 122 are described as having a plurality of slats, it is contemplated that in other embodiments the first damper 120 and/or second damper 122 may each have only one slat.

Figure 3:
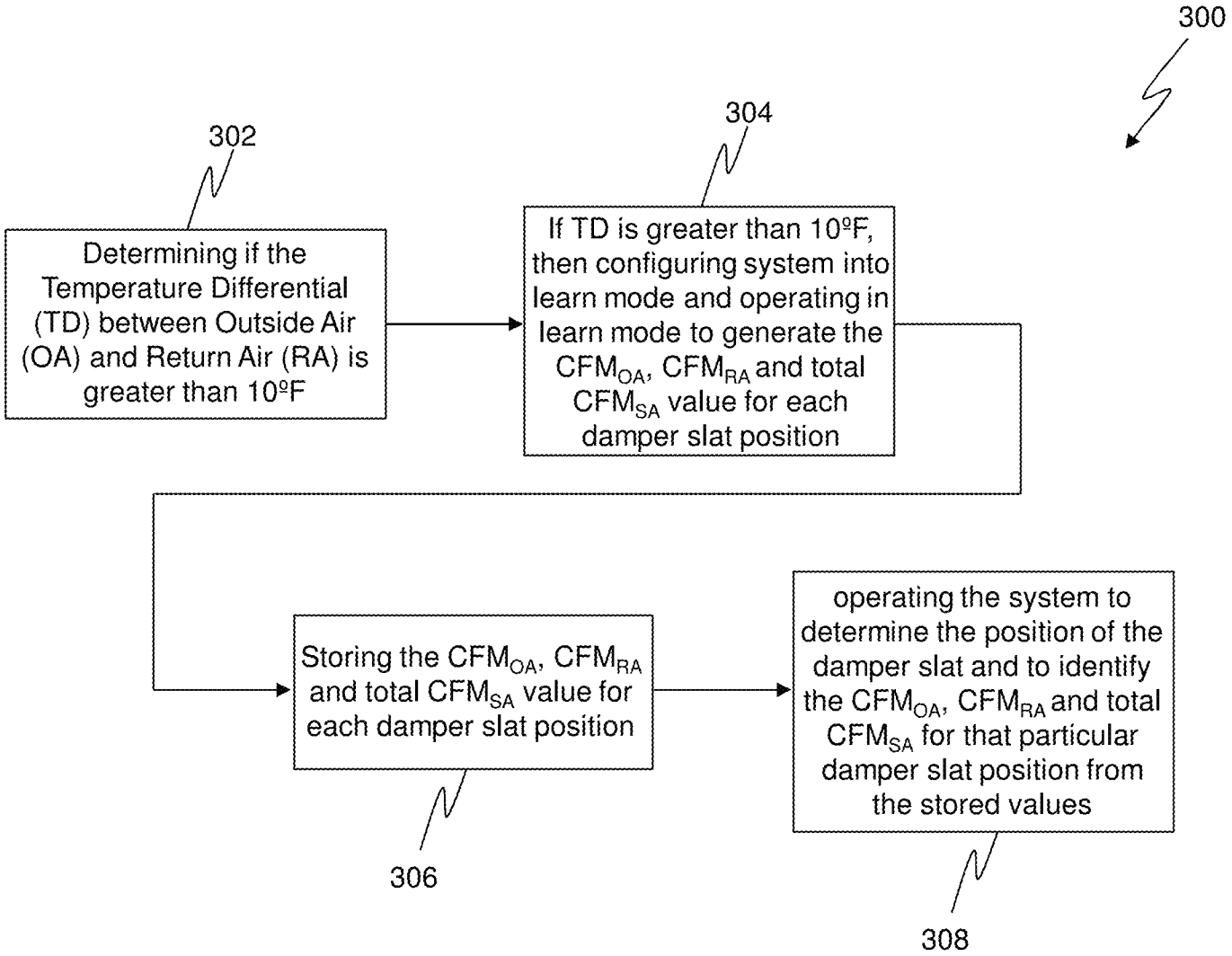
FIG. 3 shows an operational block diagram illustrating a method for measuring airflow of an HVAC system across a wide temperature range, in accordance with one embodiment of the invention.

Referring to FIG. 3, a method 300 for measuring the outside airflow (OAF) and the return airflow (RAF) into the HVAC system 100 across a wide temperature range is provided and includes determining if the temperature differential between the outside air (OA) and the Return Air (RA) is greater than 10° F., as shown in operational block 302. If the temperature differential is greater than 10° F., then the method 300 includes configuring the Airflow Measuring System 200 into a 'learning mode' and operating the system 200 in the learning mode to generate the $CFM_{OA}$, $CFM_{RA}$ and total $CFM_{SA}$ value for each damper slat position in accordance with one embodiment of the invention, as shown in operational block 304. This may be accomplished by adjusting the damper slats 124 to a first predetermined position and waiting for a predetermined period of time T to allow the hysteresis in the damper slats 124 to diminish and/or temperature sensors to acclimate. It should be appreciated that the predetermined period of time T may range from about 3 minutes (or less) to about 15 minutes (or more), as desired.

Once the predetermined period of time T has expired, the inclinometer 212 measures the position of the damper slats 124 as a damper angle degree and/or as a percentage of the opened configuration 132 and/or the closed configuration 134, as desired. It should be appreciated that the 'learning mode' may be applied to the HVAC system 100 for any desired degree range of the position of the damper slats 124 suitable to the desired end purpose. For example, in one embodiment, the HVAC system 100 may be configured to calculate outside air (OA) % and/or return air (RA) % for each 1 degree of the position of the damper slats 124, while in another embodiment the HVAC system 100 may be configured to calculate OA % and/or RA % for each 5 degrees of the position of the damper slats 124. This method may also apply using damper positions as a percentage of the opened configuration 132 and/or the closed configuration 134 of the damper slats 124, if desired.

Once the predetermined period of time T has expired and the position of the damper slats 124 has been measured, the RAT, MAT, OAT and Supply Air in cubic feet per minute ($CFM_{SA}$) are measured/determined. Once the RAT, MAT, OAT and Supply Air in cubic feet per minute ($CFM_{SA}$) are measured/determined, the % OAF into the HVAC system 100 ($CFM_{OA}$) and the actual return airflow ($CFM_{RA}$) is calculated and the $CFM_{OA}$, $CFM_{RA}$ and total $CFM_{SA}$ for the respective damper position is stored to generate a reference table (in Random Access Memory (RAM) or in a storage device), as shown in operational block 306. It should be appreciated that this step is repeated until the % OAF and actual return airflow for the HVAC system 100 is calculated for each of the positions of the damper slats 124 between a desired position range, such as for example 0° to 90° and/or 0% and 100%. These values may then be stored for future use. It should be appreciated that the % OAF (% Outside Air) in cubic feet minute ($CFM_{OA}$) and actual return airflow ($CFM_{RA}$) may be calculated using the following formulas:

$$\%\ \text{Outside Air}=((T_{RA}-T_{MA})/(T_{RA}-T_{OA}))*100;$$

$$CFM_{SA}=(V_{AF}*AF);$$

$$CFM_{OA}=(\%\ \text{Outside Air})*(V_{AF}*AF);$$

$$CFM_{RA}=(V_{AF}*AF)-CFM_{OA}.$$

The method 300 further includes operating the Airflow Measuring System 200 to determine the position of the damper slats 124 and then identifying the $CFM_{OA}$, $CFM_{RA}$ and total $CFM_{SA}$ for that particular position of the damper slat 124 from the stored values, as shown in operational block 308.

Accordingly, once the reference table is generated, the Airflow Measuring System 200 is operated to identify the temperature differential between the outside air (OA) and the Return Air (RA). If the temperature differential between the outside air (OA) and the Return Air (RA) is greater than or equal to 10° F., then the processing device is configured to process the temperature information from the OATS, the RATS and the MATS and Supply Air Output Velocity (SAOV) information from the SAS and calculate a percent of outside airflow into the outside air inlet ($CFM_{OA}$) value, an actual return airflow ($CFM_{RA}$) value and a total supply air outflow ($CFM_{SA}$) value and other values as desired. However, if the temperature differential between the outside air (OA) and the Return Air (RA) is less than 10° F., then processing device is configured to determine the position of the at least one first damper slat and determine the percent of outside airflow into the outside air inlet ($CFM_{OA}$) value, the actual return airflow ($CFM_{RA}$) value and the total supply air outflow ($CFM_{SA}$) value using the reference table by identifying the position of the slat(s) and identifying the stored values for the slat position in the reference table. Moreover, it should be appreciated that in one embodiment of the invention, the reference table can be used for a temperature differential between the outside air (OA) and the Return Air (RA) that is less than 10° F. While in other embodiments it is contemplated that the method of the invention can be used for any temperature differential between the outside air (OA) and the Return Air (RA) as desired, such as, for example, a temperature differential between the outside air (OA) and the Return Air (RA) of 20° F. Moreover, it is contemplated that the article and method of the invention may be used with an air handling system that only includes one damper.

It should be appreciated that the Airflow Measuring System 200 the method 300 for measuring the outside airflow (OAF) and the return airflow (RAF) into an air handling system across a wide temperature range may be used with any system that delivers and/or handles air, such as for example, an Air handling unit (AHU), a Rooftop Unit (RTU), a Fan coil unit (FCU), Unit ventilator (UV), a Cabinet Unit Heater (CUH) and/or any other mechanical equipment that may deliver or otherwise handle air.

It should be further appreciated that Airflow Measuring System 200 for measuring airflow for an HVAC system 100 across a wide temperature range may be automatically controlled via the processing device 210 as desired. Thus, it is contemplated that the processing device 210 may monitor the system 200 (i.e. the OATS 202, the RATS 204, the MATS 206, the SAOV), perform calibration as required and/or adjust the system 200 to environmental conditions. Moreover, it is contemplated that the Airflow Measuring System 200 may be accessed, monitored and/or controlled via an application that is present on a PDA or wireless computer by wirelessly accessing the processing device 210 and the system 200 via the PDA or wireless computer. Accordingly, it is contemplated that in at least one embodiment, the airflow measuring system 200 may be configured such that the methods and embodiments described hereinabove may also be practiced, in whole or in part, via any device suitable to the desired end purpose, such as a computer, iPod, MP3 Player, a PDA, a Pocket PC and/or a Cell phone with connection capability.

In accordance with the present invention, the method 300 for measuring airflow of an HVAC system 100 across a wide temperature range using the Airflow Measuring System 200 may be implemented, wholly or partially, by a controller operating in response to a machine-readable computer program. In order to perform the prescribed functions and desired processing, as well as the computations therefore (e.g. execution control algorithm(s), the control processes prescribed herein, and the like), the controller may include, but not be limited to, power drivers, current monitoring, temperature sensing/reading articles, a processor(s), computer(s), memory, storage, register(s), timing, interrupt(s), communication interface(s), and input/output signal interface(s), as well as combination comprising at least one of the foregoing. Additionally, the controller (software, firmware and/or any other means of control) may monitor proper operation of the system. In case a fault is detected it may switch to a redundant system/component (failure could be due to lightning strike or any other problem).

Moreover, the method 300 for measuring airflow for an HVAC system 100 across a wide temperature range may be embodied in the form of a computer or controller implemented processes. The method may also be embodied in the form of computer program code containing instructions embodied in tangible media, such as floppy diskettes, CD-ROMs, hard drives, Solid State Drives (SSD) and/or any other computer-readable medium, wherein when the computer program code is loaded into and executed by a computer or controller, the computer or controller becomes an apparatus for practicing the invention. The invention can also be embodied in the form of computer program code, for example, whether stored in a storage medium, loaded into and/or executed by a computer or controller, or transmitted over some transmission medium, such as over electrical wiring or cabling, through fiber optics, or via electromagnetic radiation, wherein when the computer program code is loaded into and executed by a computer or a controller, the computer or controller becomes an apparatus for practicing the invention. When implemented on a general-purpose microprocessor the computer program code segments may configure the microprocessor to create specific logic circuits.

It should be appreciated that while the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Moreover, it is contemplated that elements of one embodiment may be combined with elements of other embodiments as desired. Therefore, it is intended that the invention not be limited to a particular embodiment disclosed herein as the best mode contemplated for carrying out this invention, but that the invention will include all embodiments (individually and/or combined) falling within the scope of the appended claims and/or information. Moreover, unless specifically stated any use of the terms first, second, etc. do not denote any order or importance, but rather the terms first, second, etc. are used to distinguish one element from another.

I claim:

1. An Airflow Measuring System (AMS) for measuring outside airflow and return airflow for an air handling system having an outside air inlet, a mixed air chamber, a return air inlet, a supply air outlet and a supply fan having a Supply Airflow Station (SAS) with a fixed area, wherein the mixed air chamber is separated from the outside air inlet via a first damper having at least one configurable first damper slat, the AMS comprising:

an Outside Air Temperature Sensor (OATS) located proximate the outside air inlet, a Return Air Temperature Sensor (RATS) located proximate the return air inlet, a Mixed Air Temperature Sensor (MATS) located within the mixed air chamber, a damper actuator, wherein the damper actuator is communicated with the first damper to configure the at least one first damper slat between an open configuration and a closed configuration, and a processing device, wherein the processing device is configured to receive temperature information from the OATS, the RATS and the MATS and Supply Air Output Velocity (SAOV) information from the SAS and is communicated with the damper actuator to configure the at least one first damper slat between an the open configuration and the closed configuration, wherein if a Temperature Differential (TD) between Outside Air (OA) and Return Air (RA) is greater than or equal to a predetermined TD, the processing device is configured to process the temperature information from the OATS, the RATS and the MATS and Supply Air Output Velocity (SAOV) information from the SAS and calculate an amount of outside airflow into the outside air inlet ($CFM_{OA}$) value, an actual return airflow ($CFM_{RA}$) value and a total supply air outflow ($CFM_{SA}$) value, wherein if the TD between the OA and the RA is less than the predetermined TD, the processing device is configured to determine a position of the at least one first damper slat and determine the amount of outside airflow into the outside air inlet ($CFM_{OA}$) value, the actual return airflow ($CFM_{RA}$) value and the total supply air outflow ($CFM_{SA}$) value via a predetermined reference table.

2. The Airflow Measuring System (AMS) of claim 1, wherein when the AMS is initially associated with the air handling system, the processing device is configured to generate the predetermined reference table by determining the TD between the OA and the RA and when the TD is greater than or equal to the predetermined TD, the processing device is configured to communicate with the damper actuator to position the at least one first damper slat into a plurality of first damper slat positions between the open configuration and closed configuration, process the temperature information and SAOV information to determine the $CFM_{OA}$ value, the $CFM_{RA}$ value and the $CFM_{SA}$ value for each of the at least one first damper slat positions, and store the $CFM_{OA}$ value, the $CFM_{RA}$ value and the $CFM_{SA}$ value for each of the at least one first damper slat positions.

3. The AMS of claim 2, wherein, if the TD between the OA and the RA is greater than or equal to 10° F., then upon initial association with the air handling system, the processing device is configured to generate the predetermined reference table by calculating and storing the $CFM_{OA}$ value, the $CFM_{RA}$ value and the $CFM_{SA}$ value for each of a predefined number of first damper slat positions between the open configuration and the closed configuration, responsive to, $$\%\ \text{Outside Air}=((T_{RA}-T_{MA})/(T_{RA}-T_{OA}))*100;$$

$$CFM_{SA}=(V_{AF}*AF);$$

$$CFM_{OA}=(\%\ \text{Outside Air})*(V_{AF}*AF);$$

$$CFM_{RA}=(V_{AF}*AF)-CFM_{OA}.$$

4. The AMS of claim 1, further comprising a second damper, wherein the second damper includes at least one second damper slat and is configured to separate the mixed air chamber from the return air inlet.

5. The AMS of claim 4, wherein the actuator is communicated with the second damper to configure the at least one second damper slat between an open configuration and a closed configuration.

6. The AMS of claim 5, wherein at least one of the at least one first damper slat and at least one second damper slat are configurable between an open configuration and a closed configuration via a predefined number of discrete positions.

7. The AMS of claim 6, wherein at least one of, the predefined number of discrete positions is 100, and the predetermined TD is 10° F.

8. The AMS of claim 1, wherein, the processing device is configured to process the temperature information and SAOV information to determine the $CFM_{OA}$ value, the $CFM_{RA}$ value and the $CFM_{SA}$ value responsive to, $$\%\ \text{Outside Air}=((T_{RA}-T_{MA})/(T_{RA}-T_{OA}))*100;$$

$$CFM_{SA}=(V_{AF}*AF);$$

$$CFM_{OA}=(\%\ \text{Outside Air})*(V_{AF}*AF);$$

$$CFM_{RA}=(V_{AF}*AF)-CFM_{OA}.$$

9. An Airflow Measuring System (AMS) for measuring outside airflow and return airflow for an air handling system having an outside air inlet, a mixed air chamber, a return air inlet, a supply air outlet and a supply fan having a Supply Airflow Station (SAS) with a fixed area, wherein the mixed air chamber is separated from the outside air inlet via a first damper having at least one configurable first damper slat, the AMS comprising:

an Outside Air Temperature Sensor (OATS) located proximate the outside air inlet, a Return Air Temperature Sensor (RATS) located proximate the return air inlet, a Mixed Air Temperature Sensor (MATS) located within the mixed air chamber, a damper actuator, wherein the damper actuator is communicated with the first damper to configure the at least one first damper slat between an open configuration and a closed configuration, and a processing device, wherein the processing device is configured to receive temperature information from the OATS, the RATS and the MATS and Supply Air Output Velocity (SAOV) information from the SAS and is communicated with the damper actuator to configure the at least one first damper slat between the open configuration and the closed configuration, wherein if a Temperature Differential (TD) between Outside Air (OA) and Return Air (RA) is greater than or equal to 10° F., the processing device is configured to process the temperature information from the OATS, the RATS and the MATS and the SAOV information from the SAS and calculate an amount of outside airflow into an outside air inlet ($CF_{OA}$) value, an actual return airflow ($CFM_{RA}$) value and a total supply air outflow ($CFM_{SA}$) value responsive to, $$\%\ \text{Outside Air}=((T_{RA}-T_{MA})/(T_{RA}-T_{OA}))*100;$$

$$CFM_{SA}=(V_{AF}*AF);$$

$$CFM_{OA}=(\%\ \text{Outside Air})*(V_{AF}*AF);$$

$$CFM_{RA}=(V_{AF}*AF)-CFM_{OA},$$

wherein if the Temperature Differential (TD) between the Outside Air (OA) and the Return Air (RA) is less than 10° F., the processing device is configured to determine the position of the at least one first damper slat and determine the $CFM_{OA}$ value, the $CFM_{RA}$ value and the $CFM_{SA}$ value via a predetermined reference table.

10. The AMS of claim 9, wherein when the AMS is initially associated with the air handling system, the processing device is configured to generate the predetermined reference table by determining the TD between the OA and the RA and when the TD is greater than or equal to 10° F., the processing device is configured to communicate with the damper actuator to position the at least one first damper slat into a plurality of first damper slat positions between the open configuration and closed configuration, process the temperature information and SAOV information to determine the $CFM_{OA}$ value, the $CFM_{RA}$ value and the $CFM_{SA}$ value for each of the at least one first damper slat positions, and store the amount of outside airflow into the $CFM_{OA}$ value, the $CFM_{RA}$ value and the $CFM_{SA}$ value for each of the at least one first damper slat positions.

11. The Airflow AMS of claim 10, wherein the predetermined reference table is generated by processing the temperature information and SAOV information to determine the $CFM_{OA}$ value, the $CFM_{RA}$ value and the $CFM_{SA}$ value for each of the at least one first damper slat positions responsive to, $$\%\ \text{Outside Air}=((T_{RA}-T_{MA})/(T_{RA}-T_{OA}))*100;$$

$$CFM_{SA}=(V_{AF}*AF);$$

$$CFM_{OA}=(\%\ \text{Outside Air})*(V_{AF}*AF);$$

$$CFM_{RA}=(V_{AF}*AF)-CFM_{OA}.$$

12. The AMS of claim 10, wherein, if the TD between the Outside Air (OA) OA and the Return Air (RA) RA is greater than or equal to 10° F., then upon initial association with the air handling system, the processing device is configured to generate the predetermined reference table by calculating and storing the $CFM_{OA}$ value, the $CFM_{RA}$ value and the $CFM_{SA}$ value for each of a predefined number of first damper slat positions between the open configuration and the closed configuration, responsive to, $$\%\ \text{Outside Air}=((T_{RA}-T_{MA})/(T_{RA}-T_{OA}))*100;$$

$$CFM_{SA}=(V_{AF}*AF);$$

$$CFM_{OA}=(\%\ \text{Outside Air})*(V_{AF}*AF);$$

$$CFM_{RA}=(V_{AF}*AF)-CFM_{OA}.$$

13. The AMS of claim 9, further comprising a second damper, wherein the second damper includes at least one second damper slat and is configured to separate the mixed air chamber from the return air inlet.

14. The AMS of claim 13, wherein the actuator is communicated with the second damper to configure the at least one second damper slat between an open configuration and a closed configuration.

15. The AMS of claim 13, wherein at least one of the at least one first damper slat and at least one second damper slat are configurable between an open configuration and a closed configuration via a predefined number of discrete positions.

16. The AMS of claim 15, wherein the predefined number of discrete positions is 100.

17. The AMS of claim 9, wherein, the processing device is configured to process the temperature information and SAOV information to determine the $CFM_{OA}$ value, the $CFM_{RA}$ value and the $CFM_{SA}$ value responsive to, $$\%\ \text{Outside Air}=((T_{RA}-T_{MA})/(T_{RA}-T_{OA}))*100;$$

$$CFM_{SA}=(V_{AF}*AF);$$

$$CFM_{OA}=(\%\ \text{Outside Air})*(V_{AF}*AF);$$

$$CFM_{RA}=(V_{AF}*AF)-CFM_{OA}.$$

18. The AMS of claim 9, wherein the processing device is configured to, determine whether the temperature differential between the OA and the RA is greater than 10° F., wherein if the temperature differential between the OA and the RA is greater than or equal to 10° F., the upon the initial association of the AMS with the air handling system, the processing device is configured to generate the predetermined reference table by, communicating with the damper actuator to position the of at least one second damper slat into a plurality of second damper slat positions between the open configuration and closed configuration, processing the temperature information and SAOV information to determine the $CFM_{OA}$ value, the $CFM_{RA}$ value and the $CFM_{SA}$ value for each of at least one of the plurality of first damper slat positions and the plurality of second damper slat positions, and storing the $CFM_{OA}$ value, the $CFM_{RA}$ value and the $CFM_{SA}$ value for each of at the least one of the plurality of first damper slat positions and the plurality of second damper slat positions.

19. A method for measuring outside airflow and return airflow for an air handling system having an outside air inlet, a mixed air chamber, a return air inlet, a supply air outlet and a supply fan having a Supply Airflow Station (SAS) with a fixed area, wherein the mixed air chamber is separated from the outside air inlet via a first damper having at least one configurable first damper slats, wherein the method is implemented via an Airflow Measuring System (AMS) having an Outside Air Temperature Sensor (OATS) located proximate the outside air inlet, a Return Air Temperature Sensor (RATS) located proximate the return air inlet, a Mixed Air Temperature Sensor (MATS) located within the mixed air chamber, a damper actuator, wherein the damper actuator is communicated with the first damper to configure the at least one first damper slat between an open configuration and a closed configuration, and a processing device, wherein the processing device is configured to receive temperature information from the OATS, the RATS and the MATS and Supply Air Output Velocity (SAOV) information from the SAS and damper position information and is communicated with the damper actuator to configure the at least one first damper slat between an open configuration and a closed configuration, the method comprising:

determining if a Temperature Differential (TD) between Outside Air (OA) and Return Air (RA) is greater than or equal to 10° F., whereas, if the TD is less than 10° F., then determining a position of the at least one configurable first damper slat, and referencing a predetermined reference table to identify an amount of outside airflow into the outside air inlet ($CFM_{OA}$) value, an actual return airflow ($CFM_{RA}$) value and a total supply air outflow ($CFM_{SA}$) value responsive to the position of the at least one configurable first damper slat, and, if the TD is greater than or equal to 10° F., then processing temperature information from the OATS, the RATS and the MATS and SAOV information from the SAS to determine the $CFM_{OA}$ value, the $CFM_{RA}$ value and the total $CFM_{SA}$ value.

20. The method of claim 19, wherein upon initial association of the AMS with the air handling system and when the TD is greater than or equal to 10° F. and wherein the at least one configurable first damper slat includes a predetermine number of first damper slat positions between the open configuration and the closed configuration, generating the predetermined reference table by, determining the position of the at least one configurable first damper slat, processing the temperature information from the OATS, the RATS and the MATS and the SAOV information from the SAS to determine the $CFM_{OA}$ value, the $CFM_{RA}$ value and the $CFM_{OA}$ value for each of the predetermine number of first damper slat positions, and storing the $CFM_{OA}$ value, the $CFM_{RA}$ value and the $CFM_{SA}$ value for each of the predetermine number of first damper slat positions, wherein processing the temperature information from the OATS, the RATS and the MATS and Supply Air Output Velocity (SAOV) information from the SAS to determine the $CFM_{OA}$ value, the $CFM_{RA}$ value and the $CFM_{SA}$ value, includes processing the temperature information from the OATS, the RATS and the MATS and the SAOV information from the SAS responsive to, $$\%\ \text{Outside Air}=((T_{RA}-T_{MA})/(T_{RA}-T_{OA}))*100;$$

$$CFM_{SA}=(V_{AF}*AF);$$

$$CFM_{OA}=(\%\ \text{Outside Air})*(V_{AF}*AF);$$

$$CFM_{RA}=(V_{AF}*AF)-CFM_{OA}.$$

* * * * *